US006151999A

United States Patent [19]

Eklind

[11] Patent Number: 6,151,999

[45] Date of Patent: Nov. 28, 2000

[54] FOLDING HAND TOOL SET WITH RESILIENT GRIP

[75] Inventor: Howard A. Eklind, Park Ridge, Ill.

[73] Assignee: Eklind Tool Company, Franklin Park, Ill.

[21] Appl. No.: 09/348,088

[22] Filed: Jul. 6, 1999

Related U.S. Application Data

[60] Provisional application No. 60/128,161, Apr. 6, 1999.

[51] Int. Cl.[7] ..... B25B 23/00

[52] U.S. Cl. ..... 81/440; 81/177.4; 81/492; 7/138

[58] Field of Search ..... 7/138, 118, 158, 7/168; 16/110 R, 114 R, 111 R; 81/437, 439, 440, 124.4, 124.5, 177.1, 177.4, 489, 490, 492

[56] References Cited

U.S. PATENT DOCUMENTS

| | | | |
|---|---|---|---|
| D. 156,677 | 12/1949 | Smith . | |
| D. 168,900 | 2/1953 | Lutsker . | |
| D. 332,211 | 1/1993 | Scott, III . | |
| D. 332,384 | 1/1993 | Dague . | |
| D. 385,767 | 11/1997 | Sorensen et al. . | |
| 2,804,970 | 9/1957 | Kuc et al. . | |
| 4,759,645 | 7/1988 | Kuo . | |
| 5,062,173 | 11/1991 | Collins et al. | 7/118 |
| 5,146,815 | 9/1992 | Scott, III | 81/437 |
| 5,320,004 | 6/1994 | Hsiao | 81/440 |
| 5,450,774 | 9/1995 | Chang | 81/440 |
| 5,553,340 | 9/1996 | Brown, Jr. | 7/118 |
| 5,640,741 | 6/1997 | Yano | 16/114 R |
| 5,711,042 | 1/1998 | Chung | 7/138 |
| 5,791,211 | 8/1998 | Bondhus et al. . | |
| 5,950,265 | 9/1999 | Allen et al. | 7/118 |
| 5,970,828 | 10/1999 | Bondhus et al. | 81/440 |

*Primary Examiner*—Timothy V. Eley
*Assistant Examiner*—Dung Van Nguyen
*Attorney, Agent, or Firm*—Banner & Witcoff, Ltd.

[57] ABSTRACT

A folding hand tool set comprises a multiple piece plastic handle and a plurality of hand tools pivotally mounted to the handle. The handle includes first and second elongated side walls and a third side wall, or bridge wall. The side walls are arranged generally parallel to each other. The bridge wall is arranged generally perpendicular to the first and second side walls and joins them to each other. The side walls and bridge wall define an internal tool channel, and first and second tool-set mounts. The tools are pivotally mounted to the mounts and in a closed position, are generally in the tool channel. The side walls also each define an external side wall recess for a hereinafter-identified grip. The grip is mounted in the side wall recesses. The grip has the property of yielding resiliently to human hand pressure to provide a gripping action between the hand and grip during usage. The grip is supported by the side walls for strength and force transfer. Preferably, the side walls are in two identical halves along a centerline of the bridge wall. Also preferably, the recesses include openings through side walls, and the grip includes integral protuberances through the openings. Most preferably, integral connectors inside the tool set adjacent the tool channel integrally join the protuberances together, to lock the grip into the side walls.

6 Claims, 3 Drawing Sheets

FIG. 1
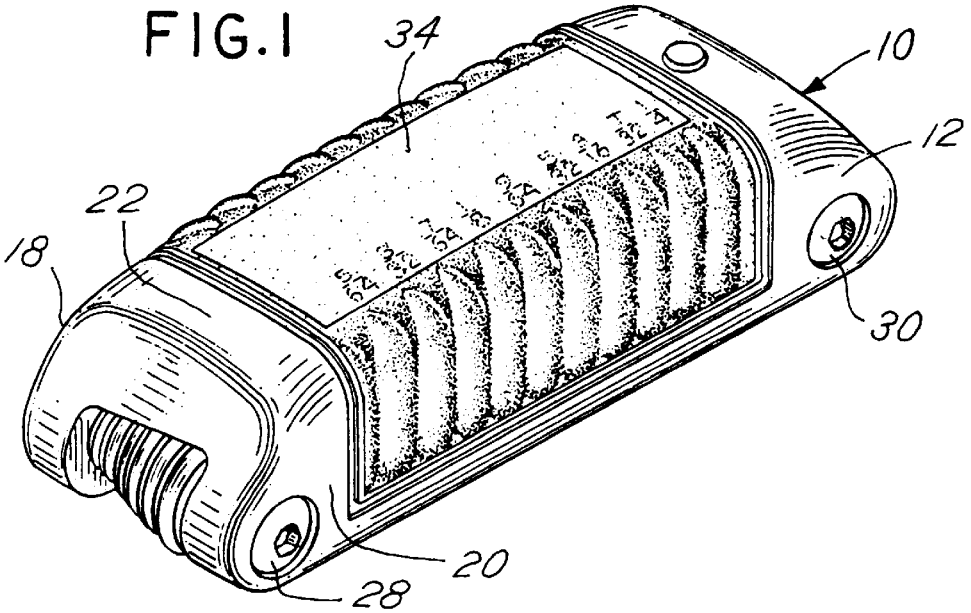
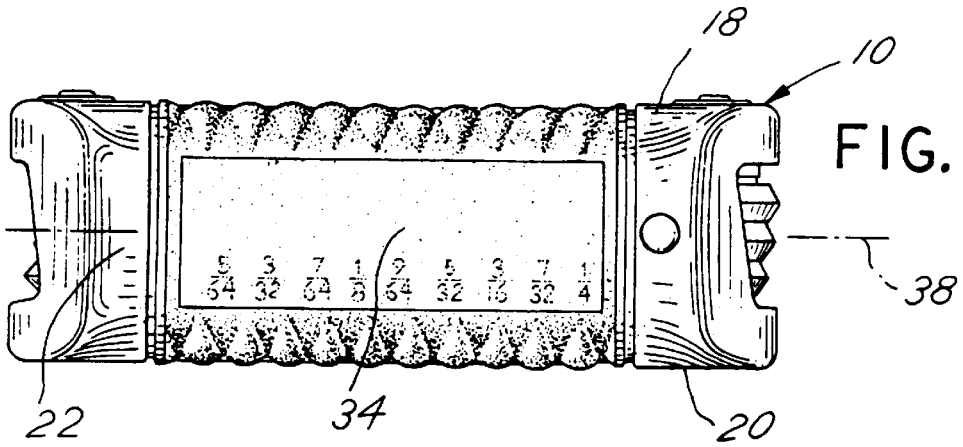
FIG. 2
FIG. 3
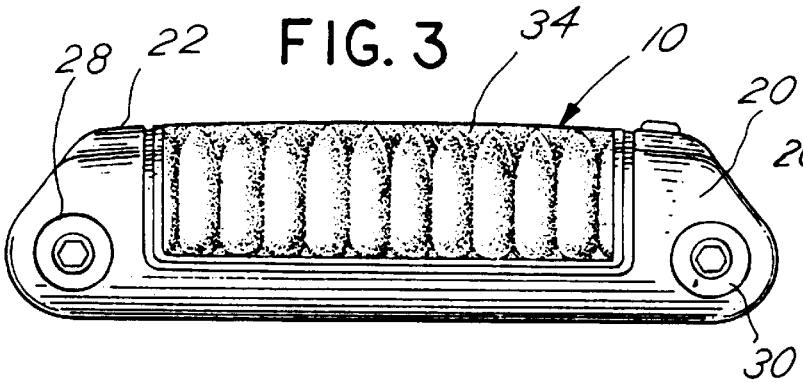
FIG. 4
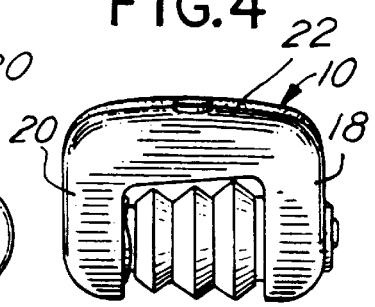

FOLDING HAND TOOL SET WITH RESILIENT GRIP

Applicant claims the benefit of provisional application Ser. No. 60/128,161, filed Apr. 6, 1999.

BACKGROUND OF THE INVENTION

1. Field of the Invention

This invention concerns folding hand tool sets, of the type used to hold sets of hex keys, screwdrivers, and similar hand tools.

2. Description of the Prior Art

The prior art in the field of folding hand tool sets includes a variety of tool sets, some with minor deficiencies, some with major. Three early sets are shown in U.S. Pat. Nos. Des. 156,677 issued in 1948; Des. 168,900 issued in 1952; and 2,804,970 issued in 1955. As reflected in all these patents, hex key tool sets were made of metal in the 1940's and 1950's, and the keys were held as in groups in holders.

Advances followed, as shown in U.S. Pat. Nos. Des. 332,211 issued in 1993, Des. 332,384 also issued in 1993; Des. 385,767 issued in 1997; 4,759,645 issued in 1988; and 5,791,211 issued in 1998. As in the last patent, a recent effort has been to form the tool set handle of fiber reinforced thermoplastic, in one piece, completely integral. Metal handles were criticized for corrosion, weight and cost. Two-piece plastic handles were criticized for lack of strength, and cost of assembly.

SUMMARY OF THE INVENTION

An object of the present invention is to advance the art of folding hand tool sets.

Another object is to advance the art in the structure and usefulness of the handle of the tool sets.

Other objects include minimizing corrosion, weight, and material and assembly costs.

Still other objects include maximizing the strength, leverage, grip, ergonomics and comfort of the handle.

Consistent with and accomplishing the objects in previously unattainable ways, a folding hand tool set of this invention comprises a multiple piece plastic handle and a plurality of hand tools pivotally mounted to the handle. The handle includes first, second and third elongated side walls. The first and second side walls, arranged generally parallel to each other, are joined or bridged by the third side wall, which is arranged generally perpendicular to the first two side walls. The side walls define an internal tool channel, and define first and second tool-set mounts at either extremity. The side walls also each define an external side wall recess for a grip. The grip is mounted and actually formed during molding in the side wall recesses. Preferably, the side walls are in two identical halves along a centerline of the tool, and the grip is in two identical halves along this centerline. The molds for the handle are then all identical halves, for minimized mold die costs. Also preferably, the recesses include openings through the two opposed side walls, and the grip includes both integral protuberances formed through the openings and integral connectors formed inside the tool set adjacent the tool channel, and integrally joining the protuberances together. All the protuberances and connectors are formed during molding of the grip on the side walls. As a result of the construction described, the grip is locked into the side walls of the handle. The grip has the property of yielding resiliently to human hand pressure to provide a gripping action of the hand and grip during usage.

The grip abuts the side walls under hand pressure, and the side walls are strong and most preferably reinforced, for secure, stable and powerful force transfer through the handle to the tools during use.

BRIEF DESCRIPTION OF THE DRAWING

FIG. 1 is a perspective view from above of the preferred embodiment of the invention.

FIG. 2 is a bottom view of the preferred embodiment, with all tools in the closed position.

FIG. 3 is a side view.

FIG. 4 is an end view.

DETAILED DESCRIPTION OF THE PREFERRED EMBODIMENT

Figure 5:
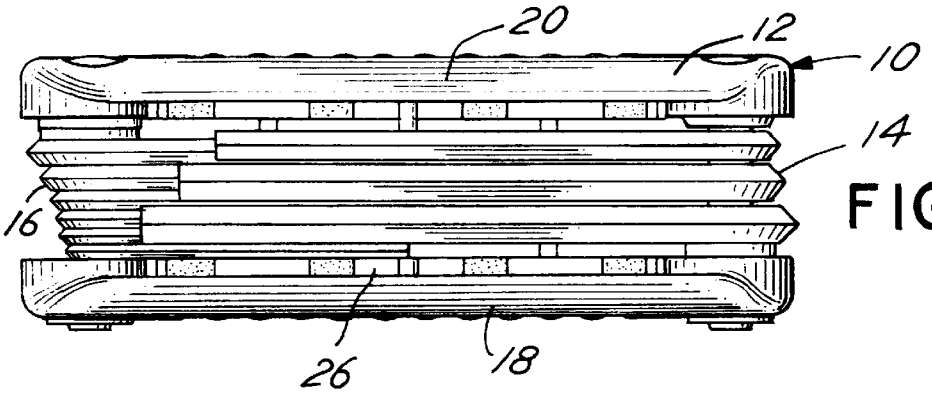
FIG. 5 is a top view.
Figure 6:
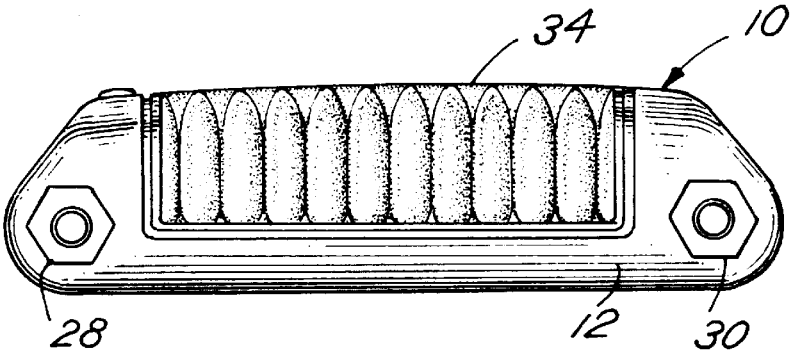
FIG. 6 is an opposite side view.
Figure 7:
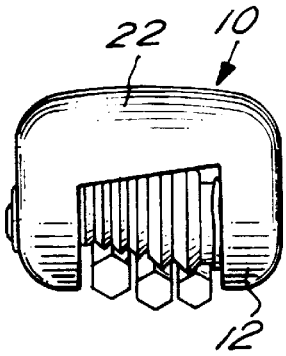
FIG. 7 is an opposite end view.

Referring to the drawing figures where appropriate, the preferred folding hand tool set 10 of this invention comprises a multiple piece plastic handle 12 and a plurality of hand tools 14, 16 pivotally mounted in sets to the handle 12.

The handle includes first and second elongated side walls 18, 20 and an elongated third side wall 22, also called a bridge wall 22. The side walls 18, 20 are arranged generally parallel to each other, and are joined by the bridge wall 22. In joining the first two side walls, the bridge wall 22 is arranged generally perpendicular to the side walls 18, 20. The side walls 18, 20, 22 co-operate to define an internal tool channel 26, best seen in FIG. 8, and first and second tool-set mounts 28, 30 at either extremity of the handle 12. The side walls 18, 20 also each define an external side wall recess 32, seen in FIG. 9, for a grip 34. The bridge wall 22 defines an external bridge wall recess 36, FIG. 9, also for the grip 34. The grip 34 is mounted and actually formed during molding in the side wall and bridge wall recesses 32, 34.

Preferably, the side walls 18, 20 and bridge wall 22 are in two identical halves along a centerline or center plane 38 of the bridge wall, FIG. 2, and the grip 34 is in two identical halves along its centerline or center plane, also 38, FIG. 2. This is also the centerline of the tool set 10. The molds for the handle are then all identical halves, for minimized mold die costs.

Figure 8:
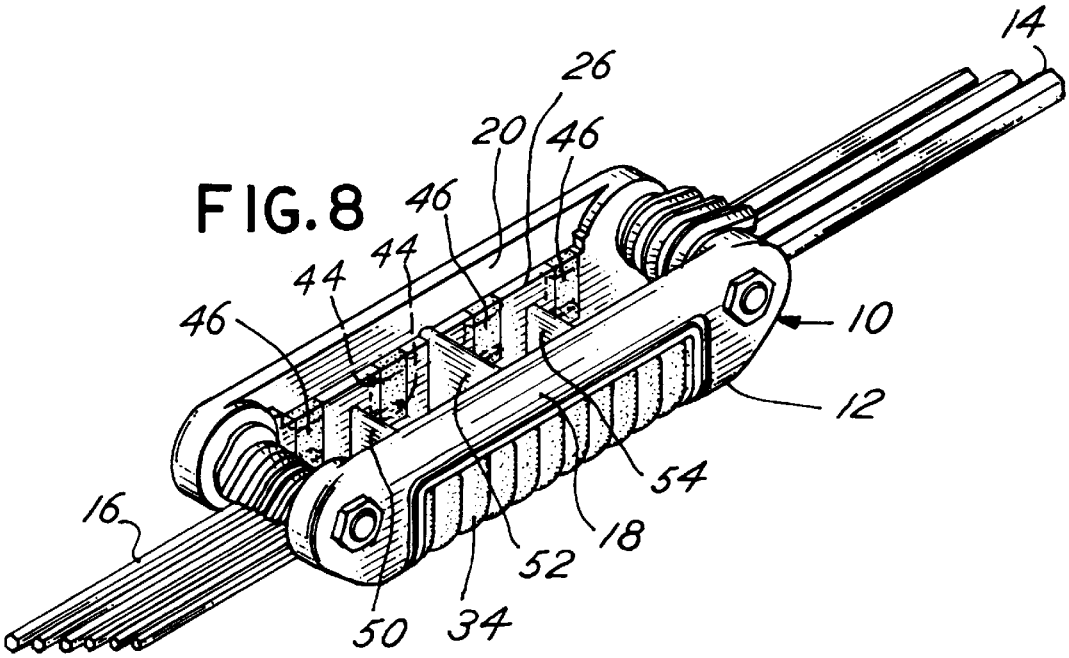
FIG. 8 is atop perspective view of the preferred embodiment, with all tools in an extended position, for illustration purposes, and with a portion of a side wall of the unit broken away to reveal internal detail.
Figure 9:
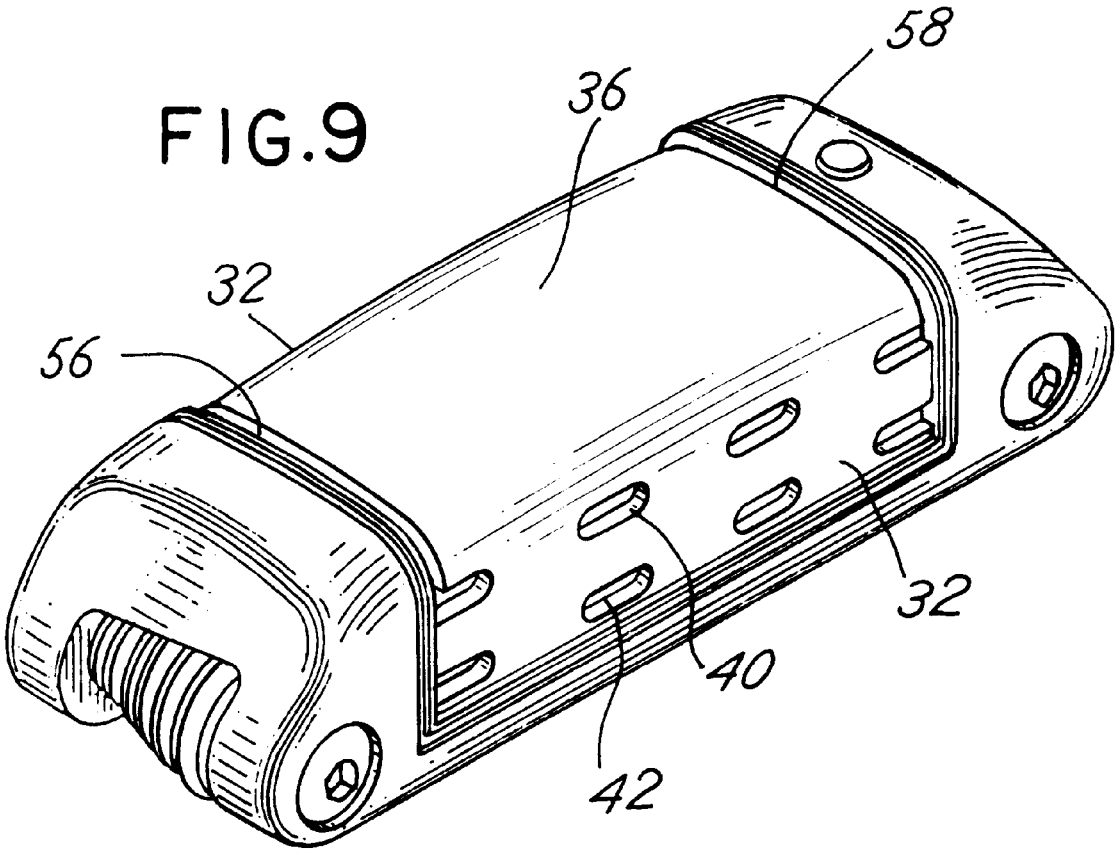
FIG. 9 is a view similar to FIG. 1, with a grip removed, again to reveal internal detail.

Also preferably, the side wall recesses 36 define longitudinally spaced pairs of openings 40, 42 through the side walls 18, 20, and the grip 34 includes integral protuberances 44, FIG. 8, formed through the openings 40, 42. The grip 34 further includes integral connectors 46, FIG. 8, formed inside the tool set 10 adjacent the tool channel 26, and integrally joining the protuberances 44 together. All the protuberances 44 and connectors 46 are formed during molding of the grip 34 on the side and bridge walls 18, 20, 22. As a result of the construction described, the grip 34 is locked into the side and bridge walls 18, 20, 22 of the handle 12.

The grip 34 is of a material such as synthetic rubber, preferably thermoplastic elastomer or similar suitable materials, and has the property of yielding resiliently to human hand pressure to provide a gripping action between, or of, the human hand and the tool grip during tool usage. Comfort is also provided.

As will be understood by the person of ordinary skill in the art, from the foregoing description, the side walls and bridge wall are injection molded first. The grip 34 is then injection molded in place.

The grip 34 abuts the side and bridge walls 18, 20, 22, across the whole of its extent under hand pressure, and the side and bridge walls 18, 20, 22 are of stiff, strong plastic, preferably glass reinforced thermoplastic polyamide or similar suitable materials, and most preferably reinforced by internal, transverse ribs 50, 52, 54. The grip, walls 18, 20, 22 and all attendant structure provide secure, stable and powerful force transfer through the handle 10 to the tools 14, 16 for excellent leverage during use of any individual tool thereof. To further the grip, ergonomics, comfort and force transfer, the grip 34 includes lips at either extremity or end of the grip 34 along the edge of the bridge wall recess 36, fitted in grooves 56, 58 of the recess 36. Additional design features may be added, as shown.

The invention, and the preferred embodiment, are now described in such full, clear, concise and exact terms as to enable a person of ordinary skill in the art to make and use the same. The disclosure of the drawing is claimed as a part of the essential disclosure of this specification. To particularly point out and distinctly claim the subject matter regarded as invention, the following claims conclude this specification.

What is claimed is:

1. A folding hand tool set, comprising:

a multiple piece plastic handle including:

first and second elongated side walls arranged generally parallel to each other, an elongated third side wall arranged generally perpendicular to the first and second side walls and joining the first and second side walls to each other, the side walls thereby defining an internal tool channel between the first and second side walls and alongside the third side wall, the side walls also defining first and second tool-set mounts on the side walls, the side walls each defining an external side wall recess, and a grip mounted in the external side wall recesses, the grip abutting the first, second and third side walls, the grip having the property of yielding resiliently to human hand pressure to provide a gripping action of the hand and grip during usage; and a plurality of hand tools pivotally mounted to the first and second mounts of the handle, and pivotable from the area of the tool recess to usage positions relative to the handle.

2. A folding hand tool set as in claim 1, the side walls being in two identical halves along a centerline of the third side wall.

3. A folding hand tool set as in claim 1, the recesses including openings through side walls, the grip including integral protuberances through the openings.

4. A folding hand tool set as in claim 3, the grip including integral protuberance connectors inside the tool set adjacent the tool channel, the connectors integrally joining protuberances together.

5. A handle for a hand tool comprising:

a channel shaped housing having parallel side walls and a bridging wall in opposed relation to an open channel, at least one of said walls having a pair of mounting apertures formed therein; and an integrally molded resilient grip overlaying a portion of said bridging wall and portions of said side walls, said grip comprising a pair of integrally molded tabs adapted to be received in said mounting apertures with distal ends extending through said aperture, and an integrally molded connecting member disposed in said channel connecting said distal ends of said tabs to one another to thereby affix said grip onto said housing.

6. The handle for a hand tool of claim 5 further comprising:

a plurality of pairs of mounting apertures formed in said side walls; and a corresponding number of mounting tabs and connecting members molded with said grip and adapted to be assembled to said pairs of mounting apertures.

* * * * *